United States Patent [19]

Mayhew

[11] 3,998,182

[45] Dec. 21, 1976

[54] CONTINUOUS METALLIC STRIP HOT-DIP METAL COATING APPARATUS

[75] Inventor: John T. Mayhew, Toronto, Ohio

[73] Assignee: National Steel Corporation, Pittsburgh, Pa.

[22] Filed: Oct. 17, 1975

[21] Appl. No.: 623,306

Related U.S. Application Data

[60] Continuation of Ser. No. 6,136, Jan. 27, 1970, abandoned, which is a division of Ser. No. 598,380, Dec. 1, 1966, Pat. No. 3,499,418, which is a continuation-in-part of Ser. Nos. 282,474, May 22, 1963, abandoned, and Ser. No. 409,053, Nov. 5, 1964, abandoned.

[52] U.S. Cl. ..... 118/8; 34/54; 118/63; 118/419

[51] Int. Cl.[2] ..... B05C 11/06

[58] Field of Search ..... 118/4, 7, 8, 9, 63, 118/420, 419; 427/8–10, 348, 349; 34/29, 54

[56] References Cited

UNITED STATES PATENTS

| | | | |
|---|---|---|---|
| 2,390,007 | 11/1945 | Sherman | 118/63 X |
| 2,415,644 | 2/1947 | Leonhard et al. | 118/7 X |
| 2,971,461 | 2/1961 | Bradford et al. | 118/9 X |
| 3,251,710 | 5/1966 | Taylor et al. | 118/7 X |

*Primary Examiner*—Morris Kaplan
*Attorney, Agent, or Firm*—Shanley, O'Neil and Baker

[57] ABSTRACT

Continuous metallic strip hot dip metal coating apparatus in which streams of gas under pressure are impinged against opposite faces of a continuous metallic strip emerging from a molten coating metal bath to thereby control the final coating weight on the strip, there being provided means for giving an indication corresponding to the final coating weight on the metal strip in combination with means responsive to such indication for controlling the impingement effect of the streams of gas under pressure to thereby obtain a desired final coating weight on the metal strip.

7 Claims, 9 Drawing Figures

INVENTOR
JOHN T. MAYHEW

Shanley & O'Neil
ATTORNEYS

INVENTOR
JOHN T. MAYHEW

Shanley & O'Neil
ATTORNEYS

INVENTOR
JOHN T. MAYHEW

Shanley & O'Neil

ATTORNEYS

INVENTOR
JOHN T. MAYHEW

Shanley & O'Neil
ATTORNEYS

CONTINUOUS METALLIC STRIP HOT-DIP METAL COATING APPARATUS

This is a continuation of application Ser. No. 6136, filed Jan. 27, 1970, now abandoned, which was a division of application Ser. No. 598,380 filed Dec. 1, 1966 now U.S. Pat. No. 3,499,418 which was a continuation in part of application Ser. No. 282,474, filed May 22, 1963 and application Ser. No. 409,053, filed Nov. 5, 1964, both now abandoned.

BACKGROUND OF THE INVENTION

This invention is concerned with molten metal coating of metal sheet material and in particular relates to novel apparatus which provide faster and more efficient production, better product control and improved product.

Although there have been many highly productive improvements in metal coating operations over the last 25 years, molten metal coating itself, especially control of coating weight, has remained essentially the same. Prior to this invention, molten metal coating operations, have relied on mechanical contact with strip at the exit side of a coating bath. This has been a slow cumbersome process, making coating weight control one of the biggest drawbacks and bottlenecks, especially in continuous strip practice.

Since hot dip zinc and zinc alloy coating, herein termed galvanizing, is the commonest form of molten metal coating operations, the invention will be described in this environment.

The invention makes a radical departure from prior art practice by providing a coating control apparatus which accurately determines coating weight in continuous strip galvanizing operations. The coating control apparatus of the invention leaves the strip free from the marks and damage occasioned by coating rolls, and the like, eliminates changing and cleaning of such mechanical contact devices, and provides numerous unexpected advantages such as increased line speeds, better operational control, a choice of manual or automatic coating weight control, smoother finish, more uniform coatings, and better corrosion protection with less consumption of coating metal.

There are pronounced contrasts between the teachings of the invention and past theories on wiping coating advanced for hot-dip tinplating. For example, the U.S. patents to Steele U.S. Pat. No. 850,548, Sebell U.S. Pat. No. 2,370,495, Sherman U.S. Pat. No. 2,390,007, and the British Patent Specification No. 588,281 disclose use of a liquid or equate use of a liquid and compressed gas in tinplating. There are similar contrasts between the teachings of the invention and the wiping action of a high velocity stream of steam passing between a coated surface and internal surfaces of a throat to blow excess metal from the surfaces of a material as disclosed in the U.S. patents to Underwood U.S. Pat. Nos. 2,080,518, 2,095,537 and U.S. Pat. Re. No. 19,758. Such theories have no application in the galvanizing industry and in fact none of these prior art theoretical disclosures is known to have found practical application in hot-dip metal coating of any kind. In practice, coating rolls, despite their many shortcomings and difficulties, remain in use throughout the strip steel galvanizing industry.

The present invention overcomes these problems by controlling coating with what is herein termed a gaseous barrier. Coating control by gaseous barrier leaves the strip free from the marks and damage occasioned by coating rolls, eliminates changing of rolls and other mechanical problems and provides numerous unexpected advantages such as increased line speeds, better operational control, smoother finish, and so forth, which will be discussed below.

In further description of the invention, reference will be had to the accompanying drawings wherein like numbers are used to denote like parts wherever possible:

Figure 1:
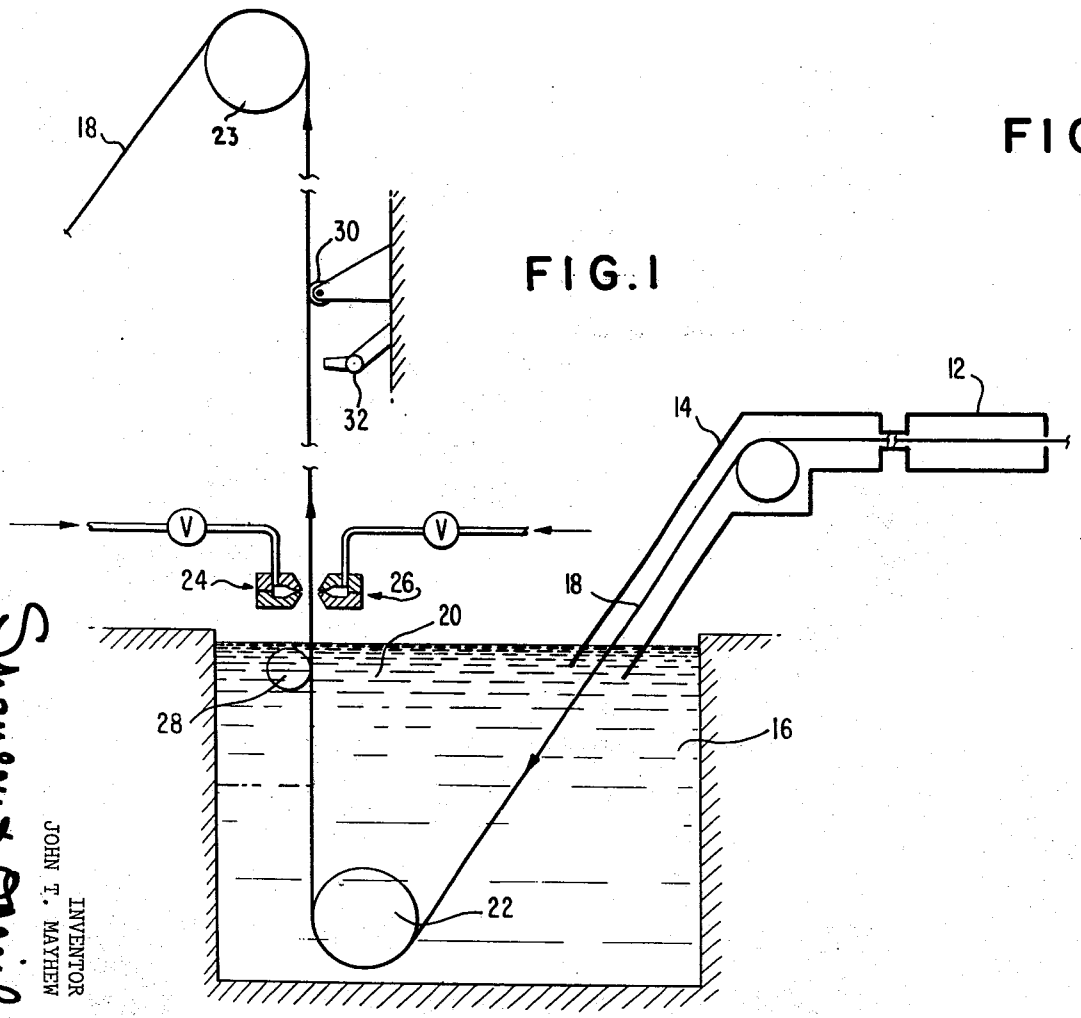
FIG. 1 is a schematic drawing of apparatus embodying the invention.

In carrying out the invention steel strip is prepared for hot-dip coating with cleaning and/or annealing apparatus 12 shown diagrammatically in FIG. 1. After preparation, the strip is delivered through controlled atmosphere chute 14 into coating bath 16 where molten coating in excess of desired final coating weight adheres to the strip. The temperature of strip 18 is ordinarily elevated several hundred degrees above atmospheric temperature and heat is added to coating bath 16 by strip 18 or in another practice the coating bath adds heat to the strip. Strip 18, after passage around sink roll 22, passes upwardly through portion 20 of the bath 16 toward top roll 23.

After exit from the coating bath the strip passes through a coating control zone where a gaseous barrier established by superheated steam jets from nozzles 24 and 26 determines the final coating weight. The steam or other heated gas is made to impinge uniformly across the full width of the strip and is confined to a thin stream (five-to fifteen-thousandths inch) in the direction of strip travel.

For proper coating metal removal nozzles 24 and 26 must be positioned to impinge the steam against the strip while the coating metal is molten and at proper temperature. These and other considerations can require the nozzles to be positioned in close proximity, about 4 to 5 inches, above the coating bath.

To obtain desired conformation, movement, and spacing in the coating control zone, roll guides are specially positioned as close as possible to the coating control zone. Referring to FIG. 1, guide roll 28 contacts the strip below but adjacent the bath surface and applies a force to the strip which may cooperate with an upper guide roll 30 to control positioning of the strip.

The shaft of guide roll 28 is positioned as close to nozzles 24 and 26 as possible without disturbing coating weight control; for example, seven or eight inches below nozzles 24 and 26, with the top of the roll submerged about 2 to 3 inches beneath the coating bath surface has been found to be optimum in a coil galvanizing line of present design.

Figure 2:
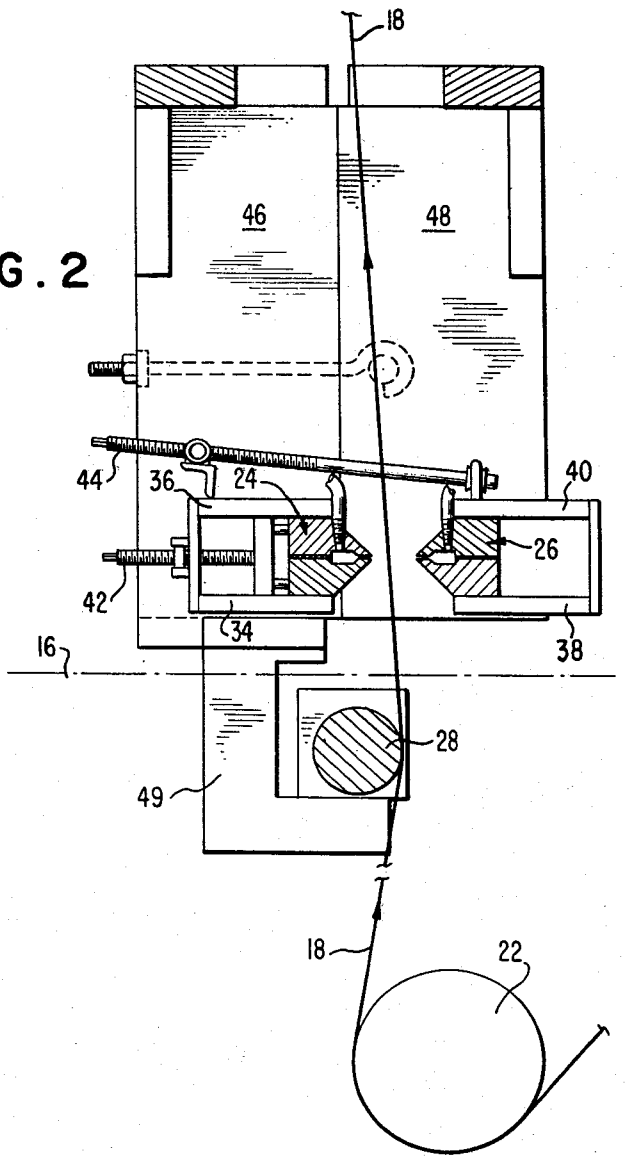
FIG. 2 is a sectional view of typical coating apparatus of the invention.
Figure 3:
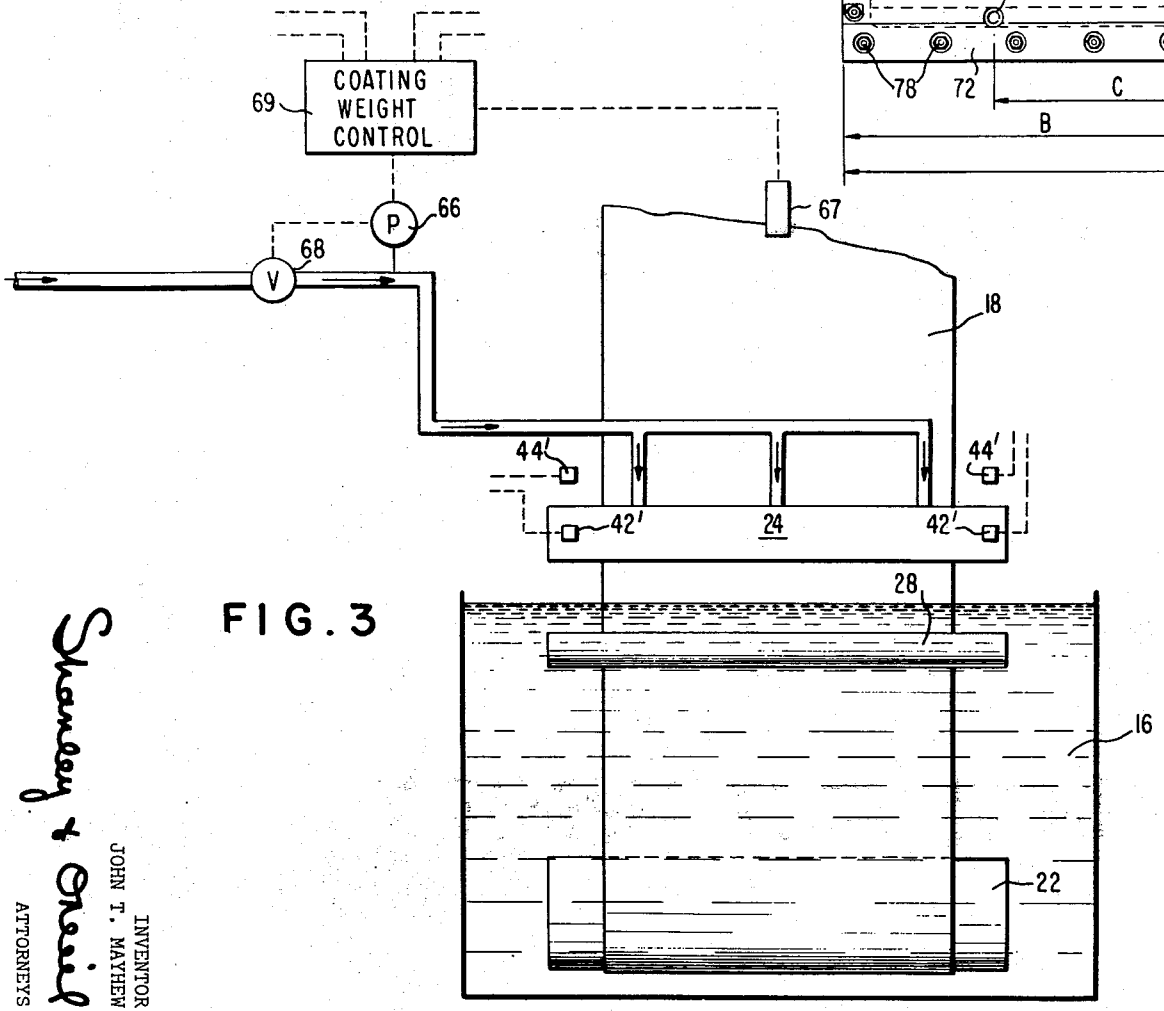
FIG. 3 is a schematic front elevational view of apparatus embodying the invention with some of the parts shown in section.

A coating control machine in accordance with the invention is shown in more detail in FIG. 2. The strip 18 passes upwardly from sink roll 22 in contact with guide roll 28 and between nozzles 24 and 26. The nozzles are supported in slides 34, 36, 38 and 40, which permit the nozzles to move toward and away from the strip. Adjustment gearing 42 and 44 which may be operable by motors 42', 44' (see FIG. 3) is connected to each nozzle for selection of spacing between each nozzle and its adjacent surface of strip 18. The adjustment means are mounted on both longitudinal ends of the nozzles, are calibrated and are adjustable from the same side of the machine. The nozzles and slides are supported by frame members 46 and 48 which are separable to permit installation of the machine without cutting the continuous strip. Frame member 46 also supports arm 49 which holds the bearing for guide roll 28. The lateral displacement of strip 18 between sink roll 22 and guide roll 28 is exaggerated in the FIG. 2 showing. In practice, a shaping and placement force is applied to strip 18 by a lateral displacement of strip 18 of around three inches between sink roll 22 and guide roll 28. An oppositely directed force may be applied at roll 30. Strip 18 moves upwardly along a substantially vertical path since any lateral offsetting is minor compared to the overall length of the longitudinal path between the sink roll 22 and top roll 23, usually forty to sixty feet, or more.

Guide roll 28 is spaced seven and one-half inches from nozzles 24 and 26 in the machine shown. This spacing can be fifteen inches or more above roll 28 dependent on a number of conditions. However, the object is to position nozzles 24 and 26 as close to guide roll 28 as possible in order to take advantage of the planar configuration of the strip imposed by roll 28. In positioning the nozzles however, turbulence of the bath and return of coating metal to the bath must be considered.

The pressure at nozzle 24 or 26 cannot be conveniently measured without disturbing the coating. Pressure measurements read at control meter 66, or a similar location, give satisfactory results once relative values for a given installation are established. Valve 68 controls the pressure of the heated gas delivered to nozzle 24 and is responsive to selected pressures at control meter 66. A similar control is provided for nozzle 26 and substantially equal pressures are used on both surfaces of the strip when equal coating weights on each surface are desired.

For automatic coating weight control, a non-contact coating thickness measurement device, such as beta ray back scattering gage 67 is positioned on each side of strip 18. Thickness measurements from the beta ray gages are delivered to coating weight control apparatus 69 and coordinated with the selected coating weight to vary the pressure delivered to each coating control nozzle or control the spacing between each nozzle and its respective side of the strip 18. Control signals are delivered over the dotted lines shown to a pressure control meter, such as 66, for each surface of the strip and to motors 42', 44' for actuation of the spacing controls 42 and 44.

Figure 5:
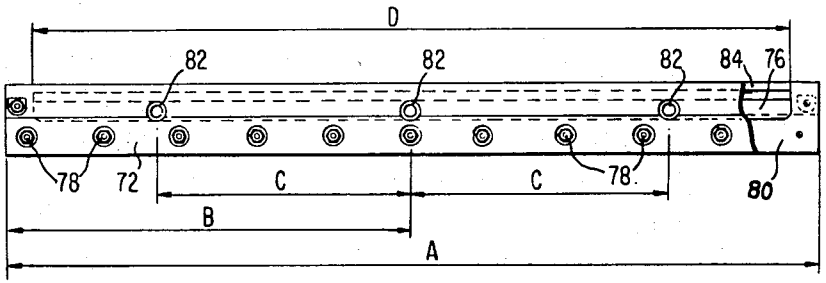
FIG. 5 is a reduced plan view of the structure of FIG. 4.
Figure 4:
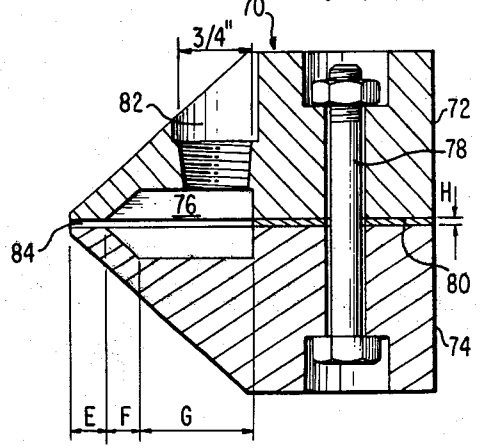
FIG. 4 is an enlarged sectional view of nozzle structure of the invention.

Details of linearly extended nozzle structure are shown in FIGS. 4 and 5. Nozzle structure 70 includes two die members 72 and 74 which mate to form a linearly extended gas manifold 76. Die members 72 and 74 are joined by a series of bolts 78. The separation between members 72 and 74 determines the nozzle opening or passageway 84 and is set by use of shim stock 80. Spacing means 80 can vary in thickness between 0.005 and 0.015 inches. Passageway 84 has an inlet opening into manifold 76 and an outlet facing the strip. Gas is supplied through a plurality of apertures 82, in order to obtain substantially uniform gas pressures across the full longitudinal length of manifold 76. The gas exits through linearly extended passageway 84. It is to be noted that the angle of entry of the gas with respect to the plane of the exit is shown as 90° but the invention is not limited to 90°; however, a substantial angular relationship is desired in order to obtain uniform gas dispersal and exit velocity across the linearly extended nozzle opening 84. Typical dimensions for nozzle structure used in obtaining data for the examples presented are:

| | | | |
|---|---|---|---|
| A | 57¾" | E | ½" |
| B | 28⅞" | F | ½" |
| C | 18" | G | 1½" |
| D | 54" | H | .015" |

One of the primary objects of nozzle structure used in gas barrier coating control of strip is a linearly extended gaseous stream of uniform gas pressure across the strip. The thickness of the gaseous barrier in a direction parallel to the strip motion is dependent on the nozzle opening which will give proper flow. Larger nozzle openings give greater gas mass and permit a greater mass of molten coating to be held back. Larger openings also avoid clogging by foreign matter; openings of 0.015 inches have been found satisfactory for mill use in this latter regard.

Figure 6:
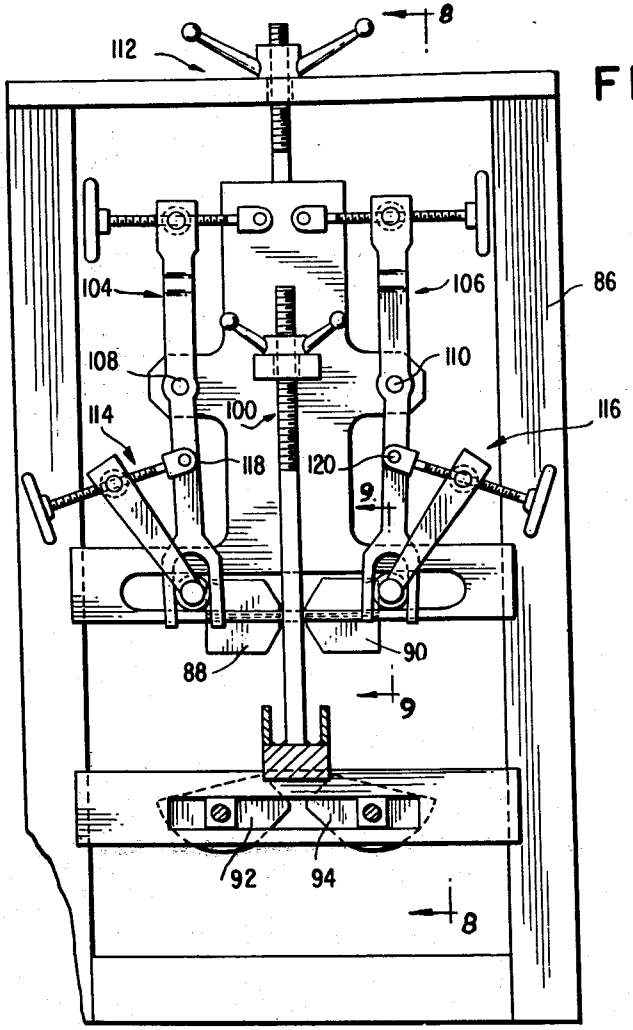
FIG. 6 is a side elevational view of gas barrier coating control apparatus embodying the invention.

FIG. 6 discloses a modification of the means for presenting the strip to the nozzles 24 and 26 in planar form and constrained against loose movement, i.e., fluttering as it passes between the nozzles. Instead of the guide roll 28 on one side of the strip, two fixed guide members 92, 94 are positioned under the surface of the bath, one on either side of the strip. The submerged guide members 92, 94 can assist in the bonding of the zinc to the strip by providing an "ironing" effect on the spelter; that is, some pressure can be exerted on the spelter during passage through guide means 92, 94. Also, they provide a near turbulence-free pocket of metal for the strip to pass through before reaching the surface of the bath. In practice, they have been found to function well when submerged several inches beneath the surface of a hot dip galvanizing bath and therefore coating for long periods can take place without additions to the bath.

FIGS. 6 through 9 show details of hot dip, gas barrier apparatus including means for adjusting angle of impingement of the gas, height of impingement above the bath, depth of submerged guide members which guide or constrain strip in a particular bath, the gap between gas nozzles, and the gap between the guide members. Where pairs of identical adjustment means exist on the same side of the strip, the same numbers have been used to identify each member of the pair.

Figure 7:
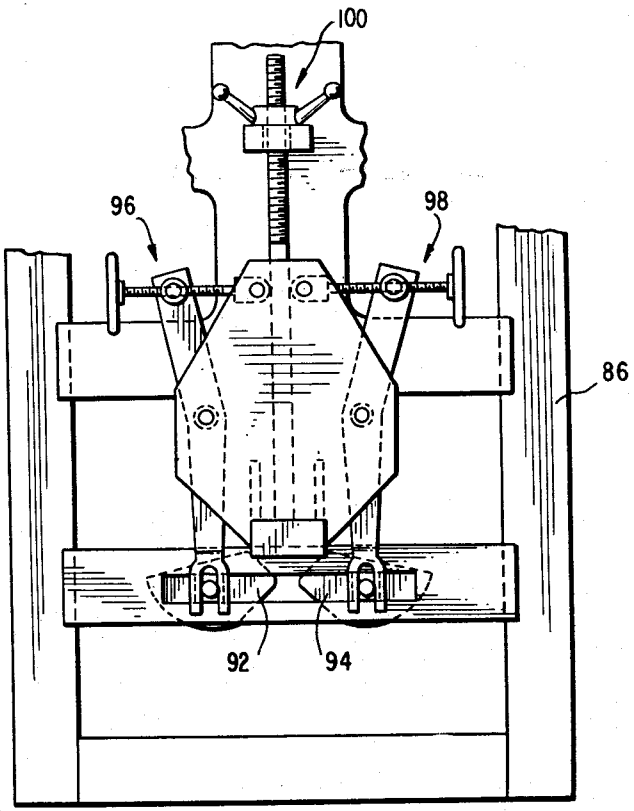
FIG. 7 is another side elevational view of gas barrier coating control apparatus embodying the invention.
Figure 8:
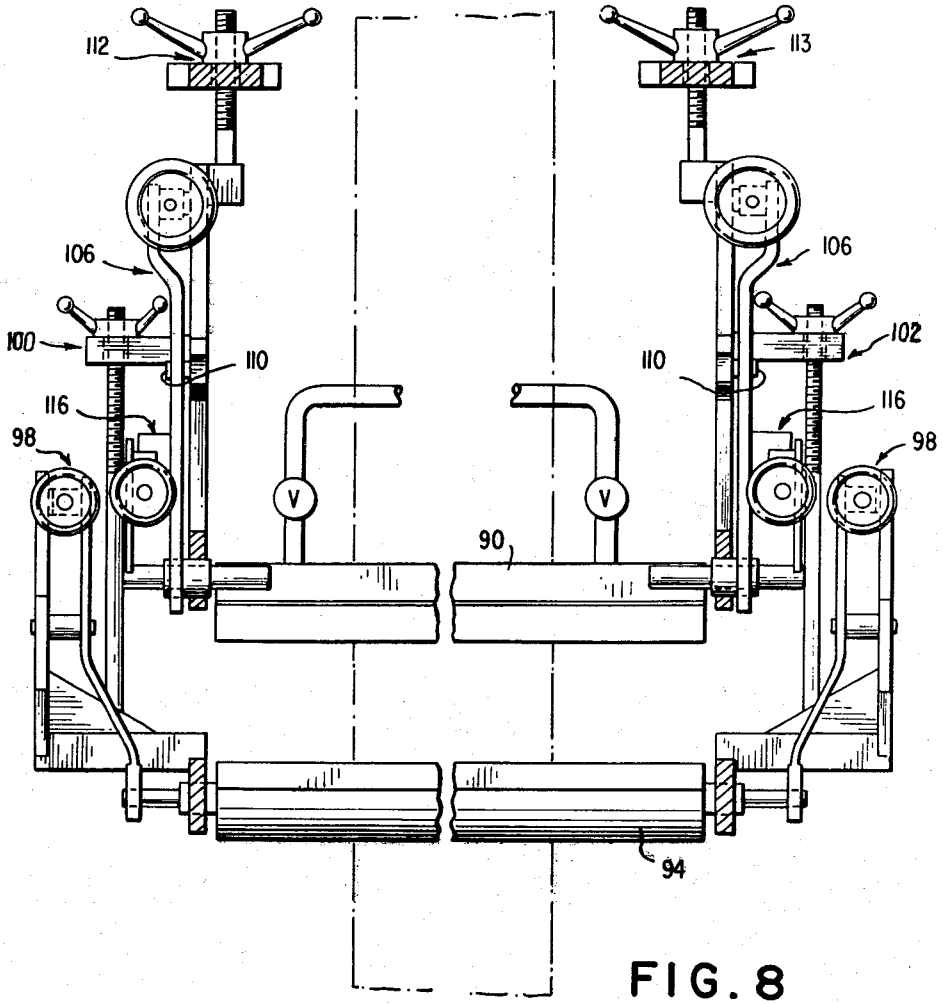
FIG. 8 is a view in section of the apparatus of FIG. 6, taken along the line 8—8.
Figure 9:
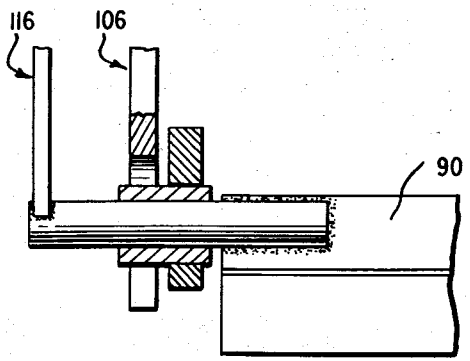
FIG. 9 is an enlarged sectional view of a portion of the apparatus of FIG. 6, taken along the line 9—9.

Framework 86 supports the entire apparatus. Nozzle structures 88, 90 are positioned above guide members 92, 94 which guide the strip into the coating control zone with substantially planar configuration. Referring in particular to FIGS. 7 and 8, guide member 92 is adjusted by linkages 96 and guide member 94 by linkages 98. Vertical location of bracing members 92, 94 is adjusted by screw mechanisms 100 and 102.

Referring to FIG. 6 in particular, the gap between the nozzle structures 88 and 90 is adjusted by linkages 104 and 106 which pivot at 108 and 110, respectively. Linkages 104, 106 are adjustable by the gearing shown which may be motorized and automated as described above in respect to gearing 42, 44. The angles of nozzles 88 and 90 can be adjusted to substantial perpendicularity by linkages 114 and 116 pivoted by 118 and 120, respectively. The nozzle structures, guide members and their respective adjustment means are moved upwardly or downwardly with respect to the framework 86 by height adjustment means 112, 113.

In the gas barrier principle, as taught by the present invention, the mass of the gas impinging against the molten coating is a dominant factor. The effect of mass can be seen from a culvert stock example where approximately 1090 pounds of steam per hour at a line speed of 110 feet per minute produced 2 ½ ounce per square foot coating while at a line speed of 130 feet per minute approximately 2200 pounds per hour produced light commercial coating near 0.6 ounce per square foot.

From an operational point of view, pressure change can be used for changing the mass of the superheated steam or other gas used. For example, with increasing line speeds the mass of coating to be held back to maintain constant coating weight increases. This increase in mass can be achieved by increasing gas pressure. Alternatively, the mass of the gas can be increased by increasing the area of the nozzle slot without increasing the gas pressure.

Speed of the line is an important factor; it has been observed that on a continuous galvanizing line, under similar operating conditions of nozzle location and superheated steam pressure, a speed of 100 feet per minute produced a "light commercial coat" while 200 feet per minute produced a commercial ounce and a quarter coating. Line speed could be used to control coating weight but, in practice, an operator would run a line at a maximum speed for a particular gage material as determined by other factors. The gas barrier could be set at the optimum height above the bath, the optimum gas opening, the gas pressure or nozzle spacing or both being then varied to control the coating weight.

Final coating weight at a given line speed can be controlled by either gas pressure or proximity of the linearly extended nozzles to the strip, or both. As described above the temperature of the coating metal applied to the strip is held substantially constant. Briefly, higher strip speeds, lower impinging gas pressure, and greater distances between nozzle and strip produce heavier coating weights; and lower strip speeds, higher impinging gas pressure, and lower distances between the nozzle and the strip produce lighter coating weights. Generally the strip speed is selected based on other limiting factors, e.g. the annealing capacity of the line, and the line is ordinarily run at the maximum speed available considering such limitation factors. It is desirable to maintain a minimum steam pressure regardless of other related coating control factors although to meet variations in required coating weight either steam pressure or nozzle spacing can be changed. In practice changing of nozzle spacing is preferred because of the desire to maintain a minimum gas pressure and to avoid over or under correcting when gas pressure controls are employed. With automatic controls either spacing or pressures can be changed readily to meet coating requirements within a selected low pressure range. Typical production examples are included below.

TABLE I

Continuous-strip galvanizing with nozzles 4½ to 5½ above bath level, coating metal at exit side of bath held at or near 825° F., nozzle opening of 0.015, substantially perpendicular impingement superheated steam temperature about 840° F., spacing between each nozzle and its adjacent strip surface about one-half inch.

| | RUN 1 | RUN 2 | RUN 3 | RUN 4 |
|---|---|---|---|---|
| Strip thickness (inches) | .020 | .0183 | .018 | .0172 |
| Strip width (inches) | 36-9/16 | 28 | 24-1/2 | 27-13/16 |
| Topside pressure (lb./in.²) | 35 | 30 | 37 | 32 |
| Bottomside pressure (lb./in.²) | 34 | 30 | 38 | 31 |
| Speed of line (fpm) | 170 | 220 | 230 | 230 |
| Coating weight (oz./ft.²) (Total of both surfaces) | .59 | .82 | .59 | .99 |

TABLE II

Continuous-strip galvanizing with nozzles 4½ inches to 5½ inches above bath level, coating metal temperature at exit side of bath held at or near 825° F., nozzle opening 0.015 inch, substantially perpendicular impingement, superheated steam temperature about 840° F., spacing between each nozzle and its adjacent strip surface about three-fourth inch.

| | RUN 5 | RUN 6 | RUN 7 | RUN 8 |
|---|---|---|---|---|
| Strip Thickness (inches) | .018 | .0217 | .021 | .0157 |
| Strip Width (inches) | 36 | 36 | 23¼ | 24 |
| Topside Pressure (lb./in.²) | 38 | 29 | 42 | 42 |
| Bottomside Pressure (lb./in.²) | 40 | 29 | 41 | 41 |
| Speed of Line (fpm) | 200 | 200 | 210 | 230 |
| Coating Weight (oz./ft.²) | .54 | .76 | .53 | .56 |

Differential-coat is readily produced by controlling gas pressure on each surface. From observation of production of differential-coat on a continuous galvanizing line, the light side coating is controlled more effectively by the gas barrier apparatus than with any known method. Imperfections in the strip on the light side of the strip are not a problem with the gas barrier apparatus and a smoother light side coating results. Differential galvanized product having less than 0.1 ounce per square foot on the light side and more than 0.3 ounce per square foot on the heavy side was produced using 55 pounds per square inch steam pressure on the bottom side manifold (light side of the differential coat) and 45 pounds per square inch steam pressure on the top side manifold.

In producing product with equal coating weight on both surfaces, the strip is ordinarily passed midway between the coating control nozzles and the steam pressure on each nozzle is about the same. In order to make differential coat product, the nozzle on the light coating side of the strip can be moved closer to the strip or the steam pressure can be increased or both. In practice, changing the spacing of the nozzles is preferred as shown in the following table.

TABLE III

With perpendicular disposition of the nozzles, drawing quality stock, 0.0503 inches gage, 37⅜ width, was produced at a line speed of 80 feet per minute with the following settings:

| | Nozzle Spacing | Pressure (lb./in.²) | Coating Weight (lb./ft.²) |
|---|---|---|---|
| Light Side | ¼" | 25 | .19 |
| Heavy Side | 1¼" | 22 | .48 |

Adjustment in spacing between nozzles to change coating weight is an advantage of the substantially perpendicular impingement concept which is not readily available with angled impingement. Spacing of angled nozzles cannot be changed without changing the point of impact of the gas with the strip. Therefore the point of impact for one nozzle may be readily offset from the other with an angled disposition. One result can be an edge buildup of coating metal. With the nozzles disposed substantially perpendicularly to the strip this problem does not exist and a new means of adjusting coating weight, by adjusting nozzle spacing is available to the operator.

With the present invention, high strip speed is not a limiting factor whereas, with mechanical contact methods, coating control was one of the major speed limiting factors. Other operations such as annealing or coiling, etc., may place some limit on a particular line but, with the present invention, the coating operation itself will not limit line speeds with present day molten metal coating lines of any type. In fact, it has been found that the gas barrier principle of this invention produces smoother finishes at higher speeds.

Some of the advantages of the gas barrier principle of coating control include increased production, improved quality and more economic production. Increased production results from the faster line speeds available with this invention over those with the prior art practice; also, less down time for a line since there is no necessity to change coating rolls, etc. Improved quality results from the avoidance of coating roll marks and the smoother finish produced by the gas barrier method. Improved economy results from the increased production referred to above, increased percentage yields, and elimination of a number of post coating treatments to improve coating surface.

I claim:

1. Continuous metallic strip hot-dip metal coating apparatus comprising a. molten coating metal bath means, b. roll means defining a travel path for continuous metallic strip through a portion of the molten coating metal of the bath means, thence through a coating weight control zone and upwardly to a point where the molten coating metal applied to the strip in the bath has solidifed, the coating weight control zone extending upwardly from the surface of the molten coating metal through the portion of the travel path in which the weight of the still molten coating metal applied to the strip in the bath can be controlled, the roll means comprising a first roll submerged in the molten coating metal and a second roll positioned above the bath means at a point where the molten coating metal applied to the strip in the bath means has solidified, c. nozzle means having two linearly extended, narrow gas outlet means, each gas outlet means having a length at least equal to the width of the strip, each gas outlet means being shaped to deliver a concentrated stream of gas under pressure of shape and mass along the length of the gas outlet means to give a desired coating weight across the width of the continuous metallic strip, d. means for supplying gas under pressure to the nozzle means, e. support means for positioning the nozzle means in the coating weight control zone with each linearly extended gas outlet means facing and symmetrically disposed in spaced relation to an opposite planar surface of the strip and spaced above the upper surface of the bath with each gas outlet means positioned to direct a stream of gas under pressure against the strip and across the width thereof with the major component of motion of the stream of gas perpendicular to the opposed planar surface of the strip, f. gas pressure control means for continuously controlling the mass of gas delivered by each gas outlet means, g. means for supporting each gas outlet means for movement toward and away from the associated planar surface of the strip, h. means for measuring the thickness of the coating metal on each associated planar surface of the strip at a point in the strip travel path located past each gas outlet means, i. means associated with means (h) for producing signals proportional to coating metal thickness measurements of means (h), j. power means associated with means (g) for moving each gas outlet means toward and away from the associated planar surface of the strip, and k. means actuated by means (i) for causing power means (j) to operate in response to the signals produced by means (i) for adjusting the distance between each gas outlet means and the associated planar surface of the strip in accordance with changes in the coating metal thickness measurements of means (h) to control the amount of molten coating metal removed from each associated planar surface of the strip in the coating weight control zone to thereby control the coating metal weight on said associated planar surface of the product.

2. Continuous metallic strip hot-dip metal coating apparatus as claimed in claim 1 in which l. means (g) include means for maintaining unchanged the direction of the stream of gas under pressure relative to the strip during movement of each gas outlet means toward and away from the associated planar surface of the strip, and m. means (l) include straight line guide means for supporting each gas outlet means for movement in a straight line parallel to the direction of the associated stream of gas under pressure toward and away from the associated planar surface of the strip.

3. Continuous metallic strip hot-dip metal coating apparatus as claimed in claim 2 in which means (g) include n. motor driven screw thread means for moving each gas outlet means toward and away from the associated planar surface of the strip.

4. Continuous metallic strip hot-dip metal coating apparatus as claimed in claim 2 in which means (g) include n. motor actuated extensible means for moving each gas outlet means toward and away from the associated planar surface of the strip.

5. Continuous metallic strip hot-dip metal coating apparatus as claimed in claim 1 in which means (g) include l. motor actuated extensible means for moving each gas outlet means toward and away from the associated planar surface of the strip.

6. Continuous metallic strip hot-dip metal coating apparatus as claimed in claim 5 in which means (g) include m. motor driven screw thread means for moving each gas outlet means toward and away from the associated planar surface of the strip.

7. Continuous metallic strip hot-dip metal coating apparatus as claimed in claim 1 in which means (g) include l. motor driven screw thread means for moving each gas outlet means toward and away from the associated planar surface of the strip.

* * * * *